US006212800B1

(12) United States Patent
Bagley

(10) Patent No.: US 6,212,800 B1
(45) Date of Patent: Apr. 10, 2001

(54) APPARATUS FOR POSITIONALLY RETAINING FLEXIBLE MATERIAL

(76) Inventor: James Bagley, 801 W. Layton Ave. (1805 S.), Salt Lake City, UT (US) 84104

( * ) Notice: Subject to any disclaimer, the term of this patent is extended or adjusted under 35 U.S.C. 154(b) by 0 days.

(21) Appl. No.: 09/464,873

(22) Filed: Dec. 16, 1999

(51) Int. Cl.[7] ..... D06C 3/08

(52) U.S. Cl. ..... 38/102.1; 38/102.2; 38/102.9; 38/102.91

(58) Field of Search ..... 38/102.1, 102.2, 38/102.4, 102.9, 102.91; 248/125.1, 125.8, 449, 676

(56) References Cited

U.S. PATENT DOCUMENTS 3,512,745 * 5/1970 Gress ..... 248/449
3,938,267 * 2/1976 Bard ..... 38/102.1
4,175,343 * 11/1979 Mathews ..... 38/102.1
4,590,695 * 5/1986 McGillivray ..... 38/102.2
5,330,143 * 7/1994 Rich et al. ..... 38/102.2 X
5,681,018 * 10/1997 Hoftman ..... 248/125.8
5,690,310 * 11/1997 Brown ..... 248/449 X
5,771,613 * 6/1998 Geils et al. ..... 38/102.1

* cited by examiner

*Primary Examiner*—Ismael Izaguirre
(74) *Attorney, Agent, or Firm*—Richard C. McComas; Patent Focus, Inc.

(57) ABSTRACT

The present invention provides an apparatus for positionally retaining flexible material. The apparatus is a substantially rectangular footed stand with an elongated cantilever member adjustably disposed along the footed stand's rectangular portion. A flexible material retaining mechanism is connected along the cantilever member's longitudinal length via a clamping mechanism. The retaining mechanism is selectively positionable about the clamping mechanism 360° in both the vertical and horizontal plane.

13 Claims, 8 Drawing Sheets

Fig. 4
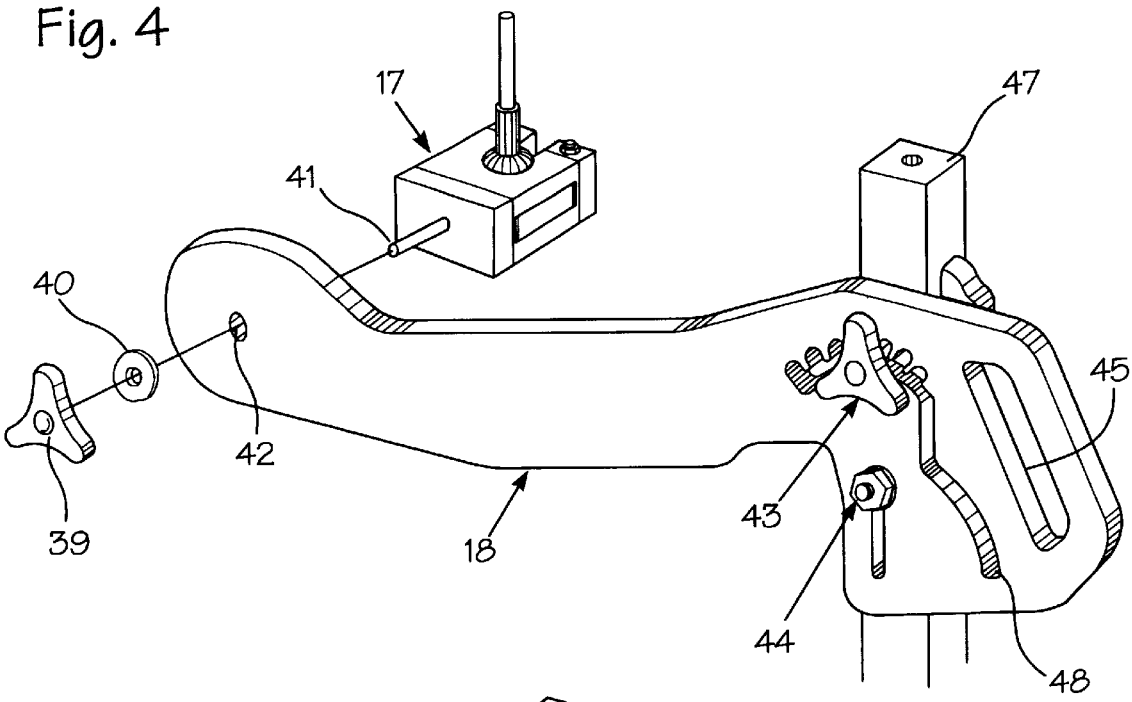
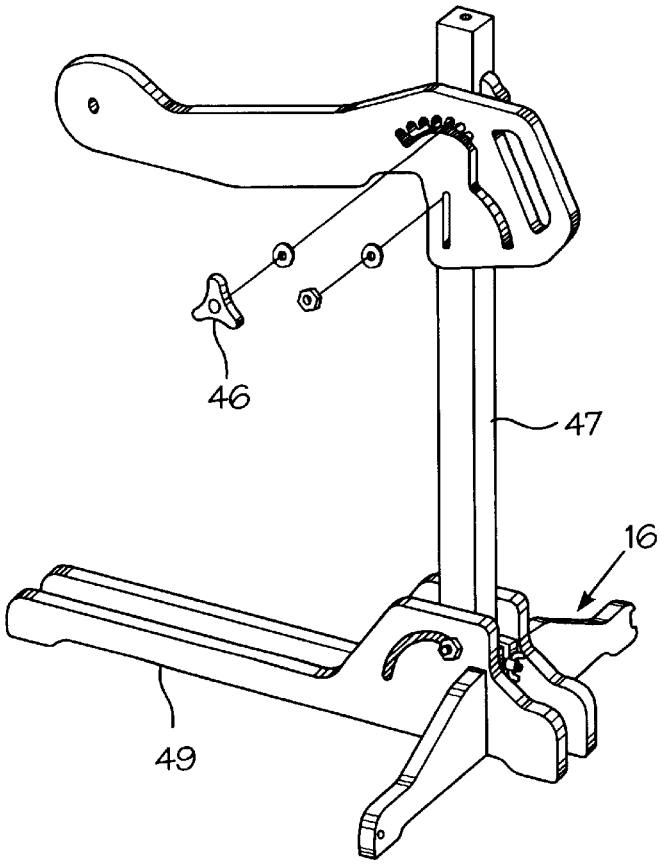
Fig. 5

APPARATUS FOR POSITIONALLY RETAINING FLEXIBLE MATERIAL

FIELD OF THE INVENTION

The invention relates, in general to an apparatus for positionally retaining flexible material. In particular the invention relates to an apparatus for positionally retaining quilting material, craft projects, and flexible fabric. More particularly the invention relates to an apparatus for positionally retaining materials quilting wherein the apparatus has a plurality of positions relative to the quilter or user. Each selected position creates a hands free environment for quilting or craft projects.

BACKGROUND OF THE INVENTION

Flexible materials that provide warmth have changed and matured over the years. For example, quilts at on time were thought of only as a means to keep warm or as a bed cover. Historically, a quilt is a coverlet or blanket made of two layers of fabric with a layer of cotton, wool, feathers, or down in-between. All are stitched firmly together usually in a decorative crisscross design. Today, quilts are still used for warmth and bed comforters but they are also works of art. The International Quilt Festival, Houston, Tex., 1999 evidenced the art form to which quilts have become. Quilts have become fabric mosaics depicting important events in people's lives and events in history. The quality and artistry of the quilters is comparable to traditional works of art.

Quilting has become a business, a recreational activity, and a source of joy for men and women alike. Machines to hold quilting material have evolved from a simplistic hoop positioned on a person's lap to very large quilting mechanisms used in factories. The quilting mechanisms used by individuals outside of a factory setting are generally quilting stands used to support the quilting material. In generally, these stands evolved from stretcher frames and embroidery hoops. These types of quilting frames are generally round. Quilts are inherently square or rectangular. The plurality of quilting workpieces used to produce a single quilt are inherently square because the quilt is square. Stretcher frames and embroidery hoops provided the quilter with a hands free environment but the quilter would be required to frequently reposition the quilting material because of the inherent difficulty in matching a square pattern to a round hoop.

In the past quilting machines that provide a hands free environment for the quilter had limited mobility and could only be positioned in a limited number of ways. The quilting stand was generally fixed or rigid and could not be easily moved, stored, or transported. The rigidity was thought to be necessary to support the weight of the quilting material. The engineering effort of the past equated weight to rigidity and rightly so. The strength of materials in the past is not the strength of materials today.

The engineering design of quilting machines or frames to be useful in quilting requires the frame to be multi-positionable. The multiple positions of the frame in relation to the quilter enables the quilter to quilt with both hands provided the frame can be locked into the selected position. In the past attempts were made to lock or clamp the frame in-place. These efforts failed because the locking or clamping mechanism was borrowed from another industry and did not lend itself to quilting. These clamping mechanisms were for positioning workpieces relative to a machine that would do work on selected workpieces.

It would be desirable to have an apparatus for positionally retaining flexible material that is easy to disassemble and fold into a compact unit for transport. The apparatus would have a substantially rectangular hoop or retaining mechanism to hold the flexible material. The hoop would be multi-positionable and enable an operator or user to use both hands when performing activities such as quilting. The retaining mechanism would be able to rotate 360° (degrees) in the vertical plane relative to the user. The retaining mechanism would be able to rotate 360° (degrees) in the horizontal plane relative to the user. The retaining mechanism would be positionally adjustable in the vertical plane relative to the user to accommodate a seated or standing user.

SUMMARY OF THE INVENTION

The present invention is a transportable multi-positionable apparatus for retaining flexible material. The present invention has a substantially rectangular hoop or retaining mechanism to hold the flexible material. The retaining mechanism may, if desired, be swivelable and positionally connected to a substantially rectangular footed stand member. The swivel action permits the retaining mechanism to rotate 360° (degrees) both the vertical and horizontal plane relative to a seated or standing user. The retaining mechanism may, if desired, be adjustably positioned vertically relative to the seated or standing user. The present invention creates a positionable and hands free environment for the seated or standing user.

The substantially rectangular footed stand member has an upright substantially rectangular portion selectively connected to a substantially rectangular footed portion. One end of an elongated cantilever member is connected to one end of the upright portion oppositely spaced from the substantially rectangular footed portion. The cantilever member's other end has the flexible material retaining mechanism mounted thereto via a clamping mechanism. The cantilever member may, if desired, be selectively adjusted in the vertical plane relative to the footed portion of the substantially rectangular footed stand member.

The clamping mechanism has an outwardly extending swivelable first shaft that is connected to the base of the retaining mechanism. The first shaft enables the flexible material retaining mechanism to rotate 360° (degrees) in the horizontal plane relative to the footed portion of the substantially rectangular footed stand member. The first shaft may, if desired, be selectively rotated 90° (degrees) with respect to the vertical plane of the footed portion of the substantially rectangular footed stand member. The flexible material retaining mechanism may, if desired, be rotated 360° (degrees) in the vertical plane relative to the footed portion of the substantially rectangular footed stand member.

The clamping mechanism has a second outwardly extending shaft. The second shaft traverses one end of the cantilever member oppositely spaced from the upright portion of the substantially rectangular footed stand member. The second shaft is adjustably secured to the cantilever member by an adjusting knob. The other end of the second shaft is connected to a clamping shoe disposed within the clamping mechanism.

The clamping shoe partially surrounds the swivel portion of the swivelable first shaft. To selectively position the flexible material retaining mechanism, the adjusting knob is loosened and the retaining mechanism is positioned as desired. The adjusting knob is then tightened causing the clamping shoe to engage the swivel portion of the first shaft and lock the swivel portion in-place.

An edge tool may, if desired, be used in concert with the present invention to provide stretching or added weight to the flexible material positioned within the confines of the retaining mechanism. The edge tool may, if desired, be an elongated shaft with a channel or slot disposed along its longitudinal length. One edge of a substantially rectangular flexible sleeve is mounted into the channel or slot. The other edge of the sleeve, oppositely spaced from the channel or slot, is detachably secured to one edge of the flexible material. During the insertion process of the flexible material into the retaining mechanism the edge tool may, if desired, be connected to the material to stretch, pull, or provide weight to the edge of the material facilitating the mounting of the material into the retaining mechanism.

When taken in conjunction with the accompanying drawings and the appended claims, other features and advantages of the present invention become apparent upon reading the following detailed description of embodiments of the invention.

BRIEF DESCRIPTION OF THE DRAWINGS

The invention is illustrated in the drawings in which like reference characters designate the same or similar parts throughout the figures of which:

FIG. 4 illustrates a perspective view diagram of the cantilever member of FIG. 1, FIG. 5 illustrates a perspective view diagram of the cantilever member mounted to the footed stand of FIG. 1.

DETAILED DESCRIPTION OF THE PREFERRED EMBODIMENT OF THE PRESENT INVENTION

Figure 1:
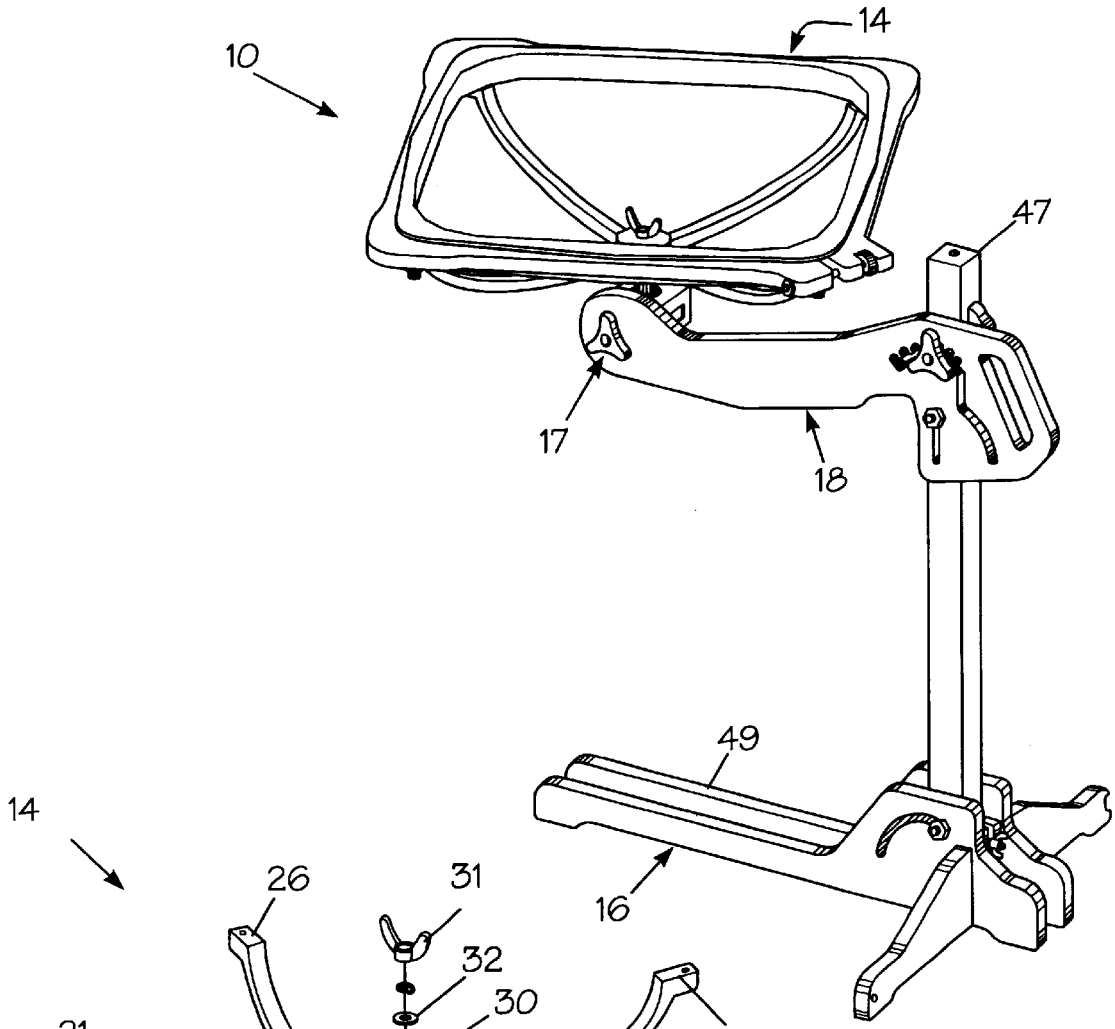
FIG. 1 illustrates a perspective view diagram of the preferred embodiment of the present invention.

Before describing in detail the particular improved apparatus for positionally retaining flexible material in accordance with the present invention, it should be observed that the invention resides primarily in a novel structural combination of conventional flexible material retaining apparatuses, discrete subsystems or subassembly components, associated control of the aforementioned flexible material retaining apparatus and components, and not in the particular detailed configuration thereof. Accordingly, the structure, command, control, and arrangement of these conventional components and subassemblies have, for the most part, been illustrated in the drawings by readily understandable diagram representations and schematic diagrams. The drawings show only those specific details that are pertinent to the present invention in order not to obscure the disclosure with structural details which will be readily apparent to those skilled in the art having the benefit of the description herein. For example, the flexible material 12, FIG. 3*a* has numerous portions or sections that may be used in the process of quilting. Only one portion of the flexible material 12 is illustrated in order to simplify and emphasize those portions of the present invention 10 that are most pertinent. Thus, the schematic diagram illustrations of the Figures do not necessarily represent the mechanical structural arrangement of the exemplary system, and are primarily intended to illustrate major hardware structural components of the system in a convenient functional grouping whereby the present invention may be more readily understood.

An Overview of the Present Invention

The preferred embodiment of the present invention 10, FIG. 1 is an apparatus for positionally retaining flexible material. Typically, a person, user, or quilter positions herself adjacent to a substantially rectangular footed stand member 16 in a standing or sitting position. The present invention 10 may, if desired, be conveniently adjusted to numerous positions to accommodate a standing or seated user. The flexible material may, if desired, be placed within the confines of the retaining mechanism 14. Any type of flexible material known in the art may be used in concert with the present invention 10. Examples of flexible material are cotton, wool, canvass, plastic, thin wood, thin metal, or polymer composite. The user may, if desired, adjust a clamping mechanism 17 to position or rotate the retaining mechanism to any convenient position.

The substantially rectangular footed stand member 16 has an upright substantially rectangular portion 47 selectively connected to a substantially T-shaped footed portion 49. The substantially rectangular footed stand member 16 has one end of an elongated cantilever member 18 connected to the upright rectangular portion 47. The other end of the cantilever member 18 is connected to the retaining mechanism 14 via the adjustable clamping mechanism 17. The retaining mechanism 14 may, if desired, be selectively positioned about the clamping mechanism 17. The vertical position of the retaining mechanism 14 may, if desired, be selected by adjusting the cantilever member 18 relative to the T-shaped footed portion 49.

A More Detailed Discussion of the Present Invention

The Retaining Mechanism

Figure 2:
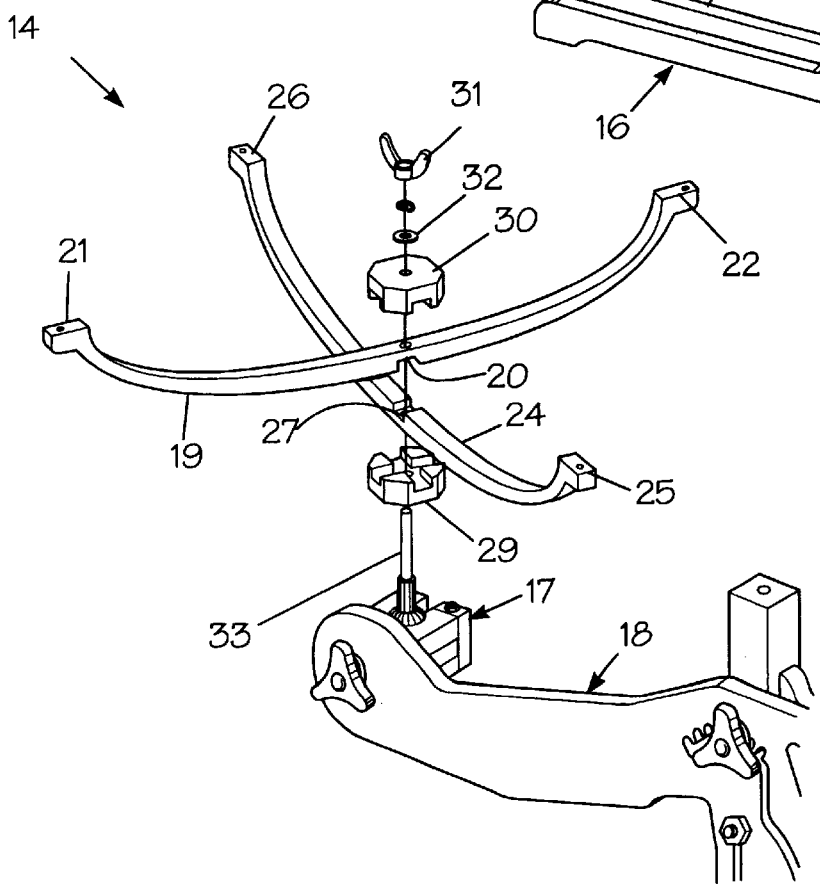
FIG. 2 illustrates a perspective exploded view diagram of the quilting material retaining mechanism of FIG. 1.

The retaining mechanism 14, FIG. 2 has an elongated arcuately shaped upper bracket 19 with a positioning notch 20 disposed along its longitudinal length. Preferably, the positioning notch 20 is centrally located with respect to the end points 21 and 22. The end points 21 and 22 are of sufficient size to accommodate the securing of an inner hoop 28, FIG. 3*a*. The end points 21 and 22 may, if desired, have an aperture disposed therethrough for connecting the upper bracket 19 to the inner hoop 28.

The retaining mechanism 14 has an elongated arcuately shaped lower bracket 24 with a positioning notch 27 disposed along its longitudinal length. Preferably, the positioning notch 27 is centrally located with respect to the its end points 25 and 26. The end points 25 and 26 are of sufficient size to accommodate the securing of an inner hoop 28, FIG. 3*a*. The end points 25 and 26 may, if desired, have an aperture disposed therethrough for connecting the lower bracket 24 to the inner hoop 28. The positioning notches 20 and 27 may, if desired, be positioned in an overlying relationship thereby enabling the weight of the quilting material to be evenly distributed along the longitudinal length of the upper and lower brackets 19 and 24 respectively.

A lower bracket plate 29 has a molded or machined top surface 33 sculpted to accommodate portions of the lower bracket 24 and upper bracket 19. An upper bracket plate 30 has a similar top surface (not shown) to accommodate portions of the lower bracket 24 and the upper bracket 19. When the upper and lower bracket plates 29 and 30 are assembled about the upper and lower brackets 19 and 24, they provide a securing mechanism for the aforementioned upper and lower brackets. The upper and lower bracket plates 29, 30, and the upper and lower brackets 19 and 24 have an aligned aperture disposed therethrough. The clamping mechanism 17 has an elongated swivel first shaft 33 extending outwardly. The first shaft 33 traverses the bracket apertures and the brackets are held in place by a retaining washer 32 and first retaining nut 31.

Figure 3A:
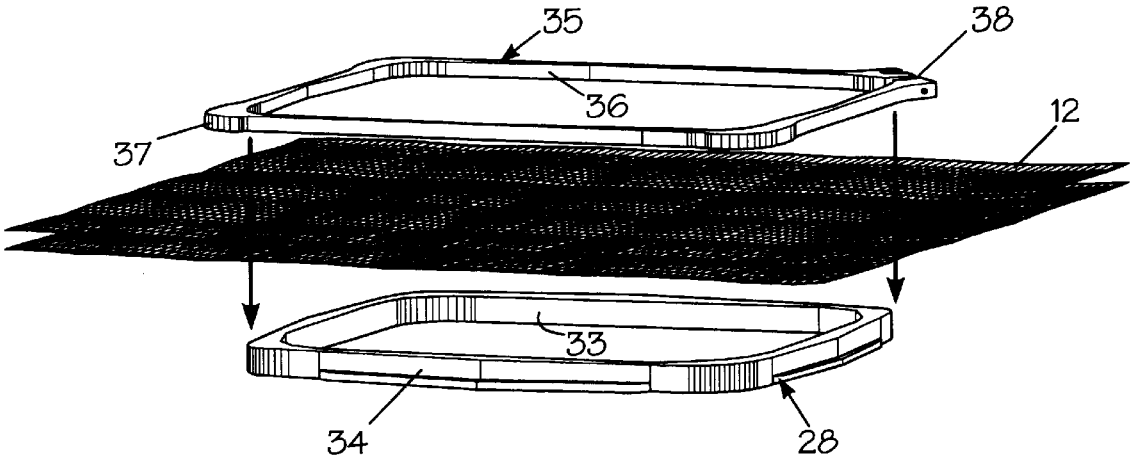
FIG. 3*a* illustrates a perspective view diagram of the inner hoop and adjustable outer hoop of FIG. 2.
Figure 3B:
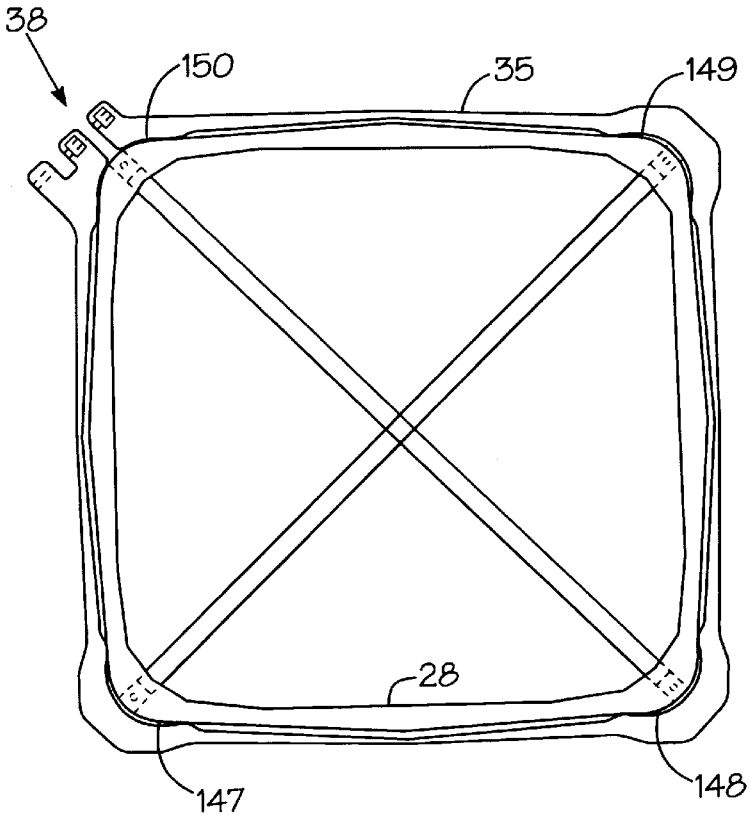
FIG. 3*b* illustrates a top view diagram of the inner hoop and adjustable outer hoop of FIG. 3*a*.
Figure 3C:
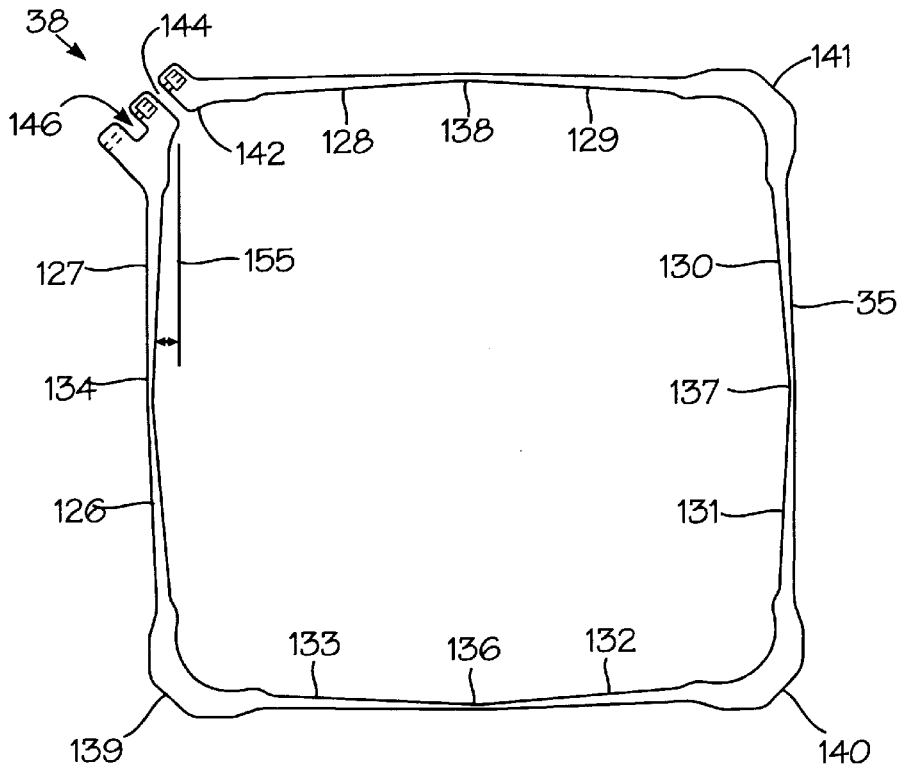
FIG. 3*c* illustrates a top view diagram of the outer hoop of FIG. 3*a*.
Figure 3D:
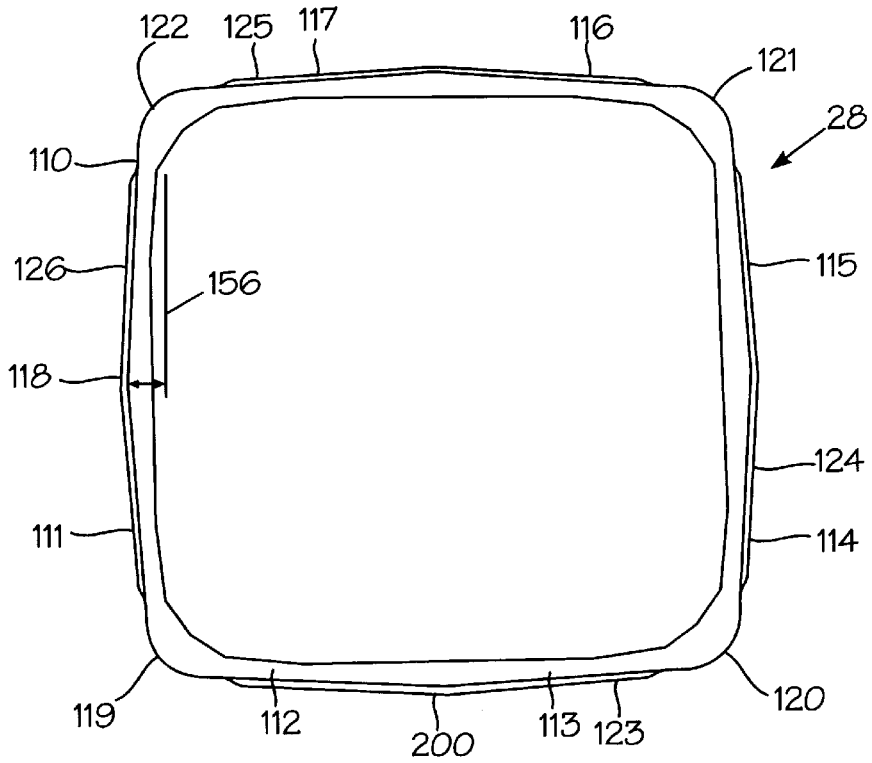
FIG. 3*d* illustrates a top view diagram of the inner hoop of FIG. 3*a*.

The inner hoop 28, FIG. 3*a* may, if desired, be any convenient physical geometry. Preferably, the inner hoop 28 is substantially rectangular in shape with rounded corners. Inner hoop 28 has an inner surface 33 surrounding an open area or cavity. The inner hoop 28 also has a plurality of holes (not shown) through which screws may be inserted to securely connect upper and lower brackets 19 and 24. The inner hoop 28, FIG. 3*d* has an outer surface that is divided into 8 distinct sections or walls that are contiguous with each other. Each pair of distinct walls is joined at an outwardly extending union along the longitudinal length of the pair of joined walls. The outward extending union is in the range of 2° to 10° (degrees) measured from the horizontal. Preferably, the angle of elevation from the horizontal is about 4° (degrees). The outer surface wall 110 joins outer surface wall 111 at 118 at an elevation angle of about 4° 156, FIG. 3*d*. Joined to one end of wall 111 is one end of a rounded corner wall 119 and joined at the other end of wall 110 is one end of round corner wall 122. The rounded corner 119 is connected to the outer wall 112 which joins outer wall 113 at 200 at an elevation angle of about 4°. Joined to one end of wall 113 is one end of a rounded corner wall 120. The rounded corner 120 is connected to the outer surface wall 114 which joins outer wall 115 at 120 at an elevation angle of about 4°. Joined to one end of wall 115 is one end of a rounded corner surface wall 121. The rounded corner surface wall 121 is connected to the outer surface wall 116 which joins outer surface wall 117 at 119 at an elevation angle of about 4° (degrees). Joined to one end of wall 117 is one end of the rounded corner wall 122. The inner hoop 28 has four distinct outwardly extending ledges connected at a 90° (degree) angle from the surface of each pair of outer surface walls. Each ledge conforms to the angular elevation of each pair of outer walls. The ledge 126 is outwardly extending from outer surface walls 111 and 110 at an angle of 90° (degrees). The ledge 123 is outwardly extending from outer surface walls 112 and 113 at an angle of 90° (degrees). The ledge 124 is outwardly extending from outer surface walls 114 and 115 at an angle of 90° (degrees). The ledge 125 is outwardly extending from outer surface walls 116 and 117 at an angle of 90° (degrees). The four outwardly extending ledges are sufficiently sized to receive the outer hoop 35. The 4 ledges extend outward from the surface of their respective surface walls about 1/16 to ½ inch. Preferably, the ledges extend outward about ⅛ inch.

Figure 9:
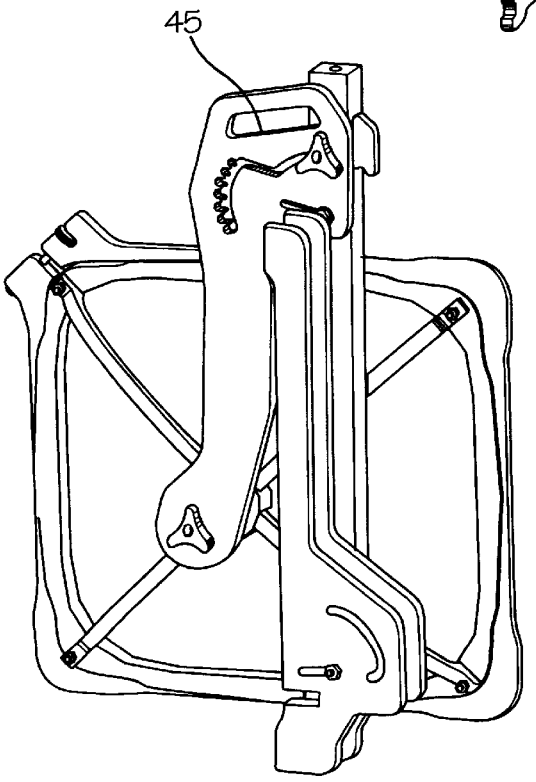
FIG. 9 illustrates a perspective view diagram of the preferred embodiment in a second folded position for storage.

The retaining mechanism 14 has an outer hoop 35, FIG. 3*a* that is sized to fit over the inner hoop 28. The outer hoop 35 may, if desired, be the same or different geometry as the inner hoop 28. Preferably, the outer hoop 35 is substantially rectangular in shape with an inner surface 36 and an outer surface 37. The inner surface 36 surrounds an opening or cavity that is sized to overlay the inner hoop 28. The outer hoop 35, FIG. 3*c* has an inner surface that is divided into 8 distinct sections or walls that are contiguous with each other. Each pair of distinct walls is joined at an outwardly extending union along the longitudinal length of the pair of joined walls. The outward extending union is in the range of 2° to 10° (degrees) measured from the horizontal. Preferably, the angle of elevation from the horizontal is about 4° (degrees). The inner surface wall 127 joins inner surface wall 126 at 134 with an elevation angle measured from the horizontal of about 4° 155, FIG. 3*c*. The inner surface wall 132 joins inner surface wall 133 at 186. The inner surface wall 131 joins inner surface wall 130 at 137. The inner surface wall 128 joins inner surface wall 129 at 138. Each pair of inner surface walls 126, 127, 130, 131, 128, and 129 are joined to rounded corners 139, 140, 141, and 142 respectively. The rounded corner 142 may, if desired, have an adjusting mechanism 38 disposed therein. The adjusting mechanism 38 comprises, in part, an adjusting slot 144, adjusting shaft 145 (not shown), and adjusting knob 148, FIG. 9. The adjusting shaft 146 traverses the adjusting slot 144. The adjusting knob 143 is disposed about the adjusting shaft 145 at 146. If desired, the adjusting mechanisms 38 component parts may be recessed within the interior of the mechanism to prevent snagging of material that would overlay the mechanism during operation. Rotating adjusting knob 143 expands or contracts the adjusting slot 144 which expands or contracts the overall diameter of the outer hoop 35.

The inner surfaces of the outer hoop 35 (discussed above) abut the outer surfaces of the inner hoop 28 (discussed above) and come to rest on the outwardly extending ledges 123, 124, 125, and 126. The adjusting knob 143 is rotated (discussed above) and the outer hoop 35 is adjustably secured about inner hoop 28. When the outer hoop 35 is positioned over the inner hoop 28 the rounded corners 139, 140, 141, and 142 of the outer hoop 35 are spaced from the rounded corners 119, 120,121, and 122 of the inner hoop 28. The gaps 147, 148,149, and 150 are formed between the respective spaced apart rounded corners. The range of the gap between any two spaced apart rounded corners is in the range of 1/32 to about ¾ inch. Preferably, the gap is about ⅛ inches.

The selected portion of the flexible material 12 may, if desired, be positioned between the inner hoop 28 and the outer hoop 35. Preferably, the weave of the material 12 is aligned at right angles to the inner hoop's 28 inner surface walls. Positioning the material in this manner enables the material to retain its form without stretching due to contact with present invention 10. The outer hoop 35 is positioned over the material 12 and the inner hoop 28 coming to rest on the ledges 123, 124, 125, and 126. The adjusting knob 143, in concert with the adjusting slot 144 tighten the outer hoop 35 about the inner hoop 28. The material 12 disposed in gaps 147, 148, 149, and 150 is adjustable secured in the gaps but is not engagingly secured by the rounded pairs of spaced apart rounded corners. Securing the corners of the material 12 in this in this manner preserves the form of the material without stretching the material.

The retaining mechanism 14 may be fabricated from any convenient material known in the art. The surfaces of the retaining mechanism 14 may be machined, polished, painted or rough honed. Examples of material that may be used to fabricate the retaining mechanism are wood, metal, plastic, or composite polymer.

The Cantilever Member

The cantilever member 18, FIG. 4 is substantially rectangular in shape. The cantilever member 18 may, if desired, be fabricated from the same or different material as the retaining member 14. The clamping mechanism 17 mounts to one end of the cantilever member 18. The other end of the cantilever member 18 is sized to accommodate horizontal adjustment controls 44 and 43 respectively. This end of the cantilever member 18 has a handle 45 mounted thereto for carrying the present invention 10 when it is in a folded position (discussed herein). An aperture or hole 42 is provided at one end of the cantilever member 18 for insertion of a second shaft 41 of the clamping mechanism 17 (discussed herein). The second shaft 41 freely slides or traverses along the inner walls of the hole 42. A knob 39 adjustably secures the clamping mechanism 17 to the cantilever member 18.

The vertical adjustment 43 is ratchet controlled. A knob 46 is mounted onto a threaded shaft extending outward from upright substantially rectangular portion 47 of the substantially rectangular footed stand member 16. The knob 46 may be selectively loosened and the cantilever member 18 may then be ratcheted up or down with respect to the horizontal plane. The range of vertical displacement provided by the ratchet control is in the range from 0 to about 20 inches. Retaining wing nut 43 mounted to a second threaded shaft extending outward from the upright substantially rectangular portion 47 along with knob 46 may be loosened, if desired, and the cantilever member 18 may be rotatively adjusted along slot 48. This rotative adjustment enables the cantilever member 18 to be positioned vertically relative to the user. The vertical displacement or distance traveled in the vertical plane is 2 to about 24 inches.

The Substantially Rectangular Footed Stand Member

Figure 6:
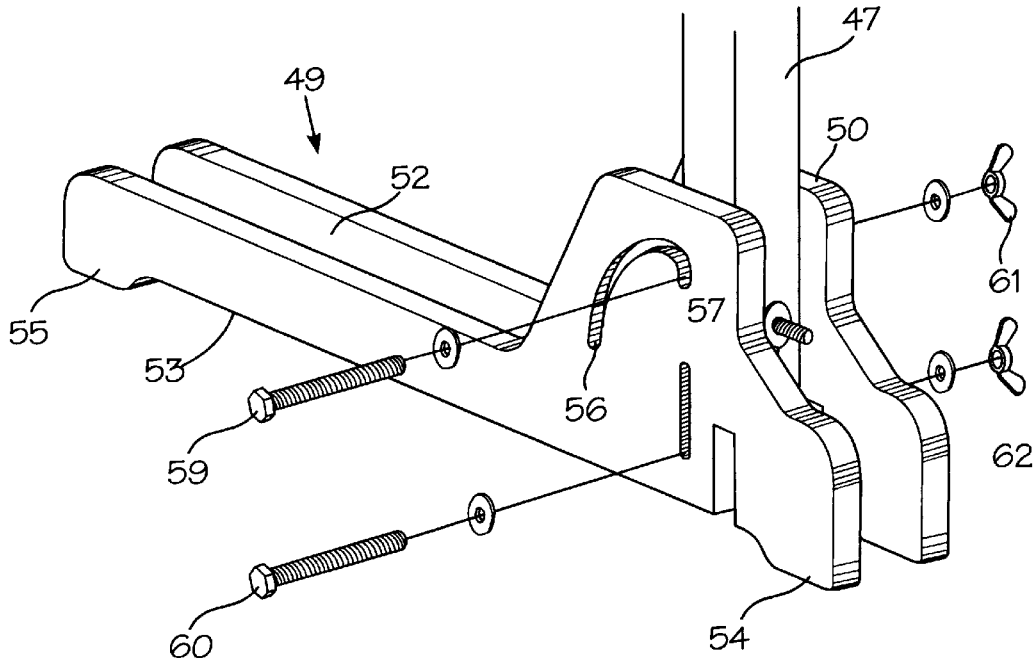
FIG. 6 illustrates a partial exploded perspective view diagram of the footed stand of FIG. 1.
Figure 7:
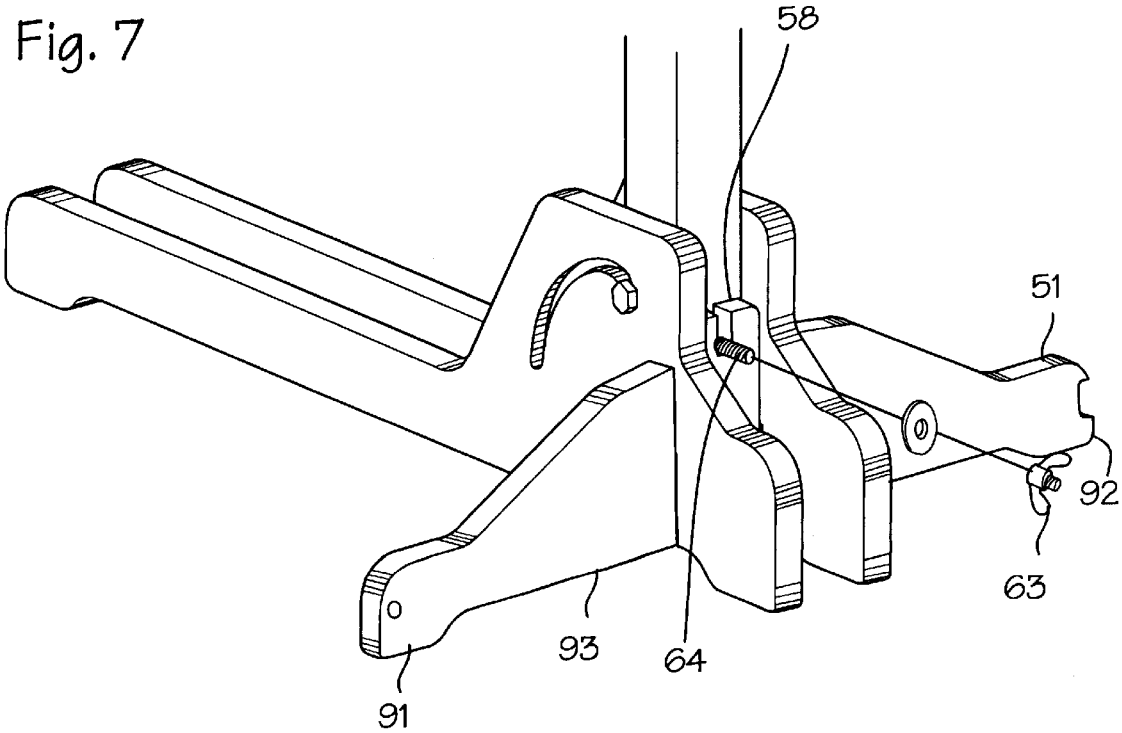
FIG. 7 illustrates a perspective view diagram of the footed stand of FIG. 1.

The substantially rectangular footed stand member 16, FIG. 5 has a substantially T-shape footed portion 49 with a substantially elongated rectangular upright portion 47 mounted thereto. The substantially rectangular footed stand member 16 may, if desired, be fabricated from the same or different material as the retaining member 14. The T-shape footed portion 49, FIG. 6 has a first elongated substantially rectangular member 50 comprising a top surface 52 and a bottom surface 53. The first elongated substantially rectangular member 50 has a pair of oppositely spaced apart protuberances or feet 54 and 55 extending outward from the bottom surface 53. The feet 54 and 55 partially support the weight of the present invention 10. The first elongated substantially rectangular member 50 has one end sized to accommodate an arcuate slot 56 and spaced therefrom a longitudinal slot 57. The substantially rectangular footed stand member 16 has a second elongated substantially rectangular member 51, FIG. 7. The second rectangular member 51 has at least one slot 58 disposed along one edge. The second rectangular member 51 has a pair of oppositely spaced apart protuberances or feet 91 and 92 extending outward from the bottom surface 93. The feet 91 and 92 partially support the weight of the present invention 10. The feet 91 and 92, in concert with feet 54 and 55, support the weight of the present invention 10 when in the upright position. The second rectangular member 51 is mounted onto one end of the first rectangular member 50 in such a way as to form a T-shape. The elongated rectangular upright portion 47 has one end inserted into an open area disposed in one end of the first rectangular member 50. A headed first threaded shaft or hex head bolt 59 traversing the arcuate slot 56 and the rectangular upright portion 47 is adjustably secured by a wing nut 61. A headed second threaded shaft or hex head bolt 60 traversing the elongated slot 57 and the rectangular upright portion 47 is adjustably secured by a wing nut 62. Loosening the wing nuts 61 and 62 enables the user to either horizontally position the present invention 10 relative to the user or fold the footed portion 49 against the rectangular stand member 49. To lock the rectangular upright portion 47 in the upright position or perpendicular to the footed stand portion 49 a third threaded shaft or hex head bolt 64 traverses the rectangular upright portion 47 and the second rectangular member 51 and is securely tightened by a wing nut 63.

Figure 8:
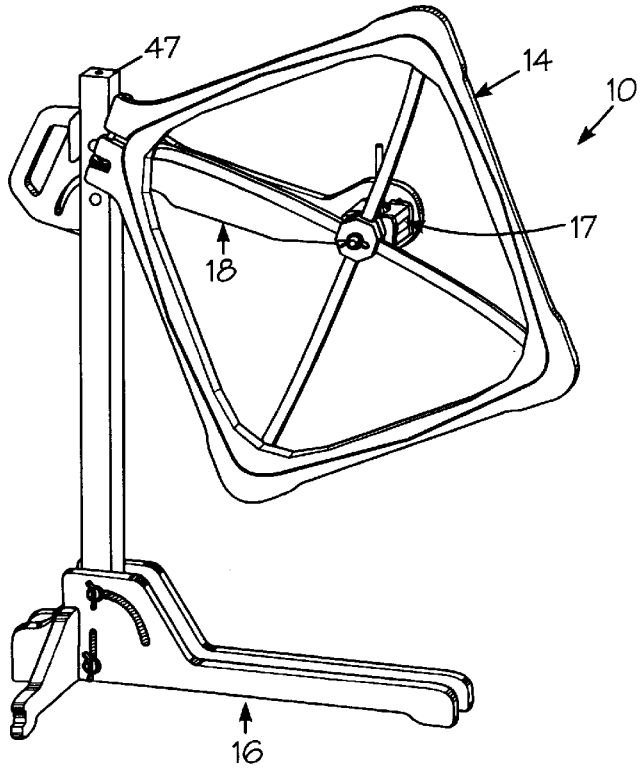
FIG. 8 illustrates a perspective view diagram of the preferred embodiment in a first folded position for storage.
Figure 10:
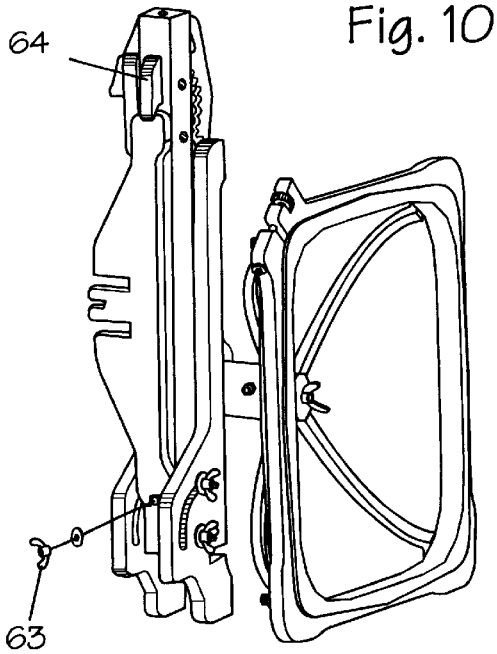
FIG. 10 illustrates a perspective view diagram of the preferred embodiment in a third folded position for storage.

To fold the present invention 10 from an unfolded or first position into a convenient folded or second position sized for transport or storage, the retaining mechanism 14, FIG. 8 is positioned along the cantilever member 18. The substantially rectangular footed stand member 16's substantially T-shaped footed portion 49 is folded along the substantially rectangular upright portion 47. The adjusting knob 46 is loosened and the cantilever member 18 is folded along the rectangular upright member 47, FIG. 9 locking the first rectangular portion 49 against the rectangular upright portion 47. The second rectangular member 51 is positioned along the rectangular upright member 47, FIG. 10 and securely connected at one end by retaining notch 64. The other end of the second rectangular member 51 is connected to hex bolt 64 and held securely in place by wing nut 63. The present invention 10 may now be transported using handle 45, FIG. 9.

The Clamping Mechanism

Figure 11:
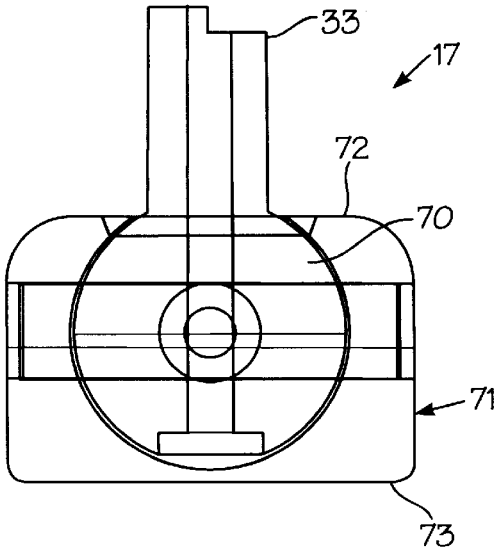
FIG. 11 illustrates a sectional front view diagram of the clamping mechanism of FIG. 1.
Figure 13:
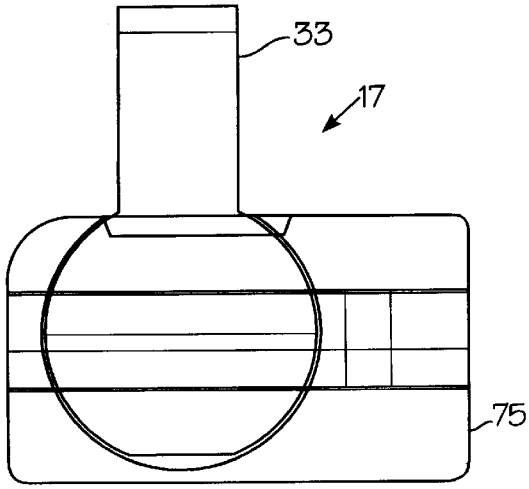
FIG. 13 illustrates a sectional side view diagram of FIG. 11.
Figure 12:
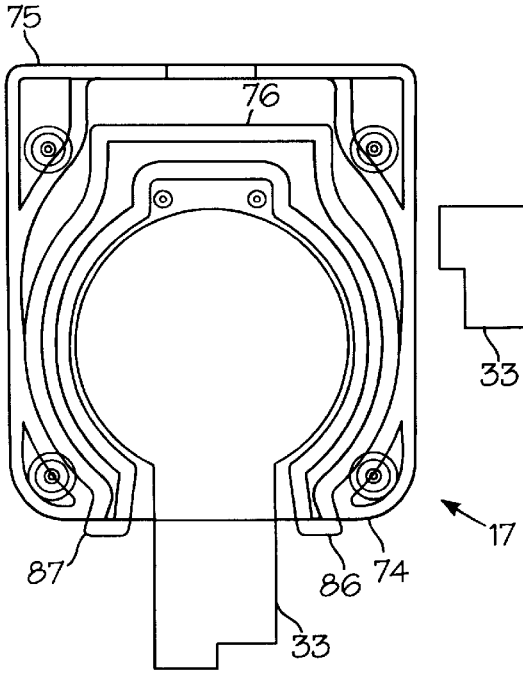
FIG. 12 illustrates a sectional top view diagram of FIG. 11.
Figure 14:
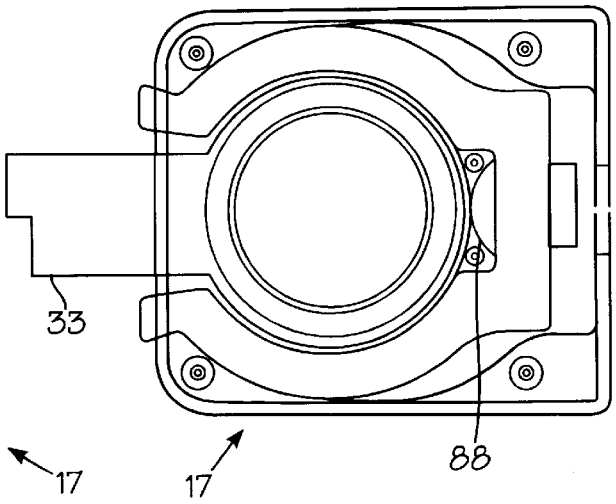
FIG. 14 illustrates a sectional bottom view of FIG. 11.

The clamping mechanism 17, FIG. 1 enables the retaining mechanism 14 to rotate about swivel shaft 33, FIG. 11, 360° (degrees) in the horizontal plane and 360° (degrees) in the vertical plane relative to T-shaped portion 49 of the substantially rectangular footed stand member 16. The clamping mechanism 17 may, if desired, be fabricated from the same or different material as the retaining member 14. The swivel shaft 33 has a molded or attached substantially spherically shaped ball 70 disposed at one end. A housing 71 has a top wall 72, a bottom wall 73, a front wall 74, and a swivel end wall 75 that partially subtend or partially surround the ball 70. The swivel shaft 33 extends through an opening in the top wall 72. The opening is sufficiently sized to permit the swivel shaft 33 in concert with the ball 70 to rotate 360° in the horizontal plane. The swivel shaft 33 may, if desired, be rotated 90° through an opening in the front wall 74. The opening in the front wall 74 is continuous or contiguous with the opening in the top wall 72. The opening in the front wall 74 is sufficiently sized to permit the swivel shaft 33 in concert with the ball 70 to rotate 360° in the vertical plane. The swivel shaft 33 may, if desired, be secured in any selected or desired position from either opening in the top or front walls 72 and 74 respectively. The interior of the housing 71 is sized to receive a clamping shoe 76, FIG. 12.

Figure 15:
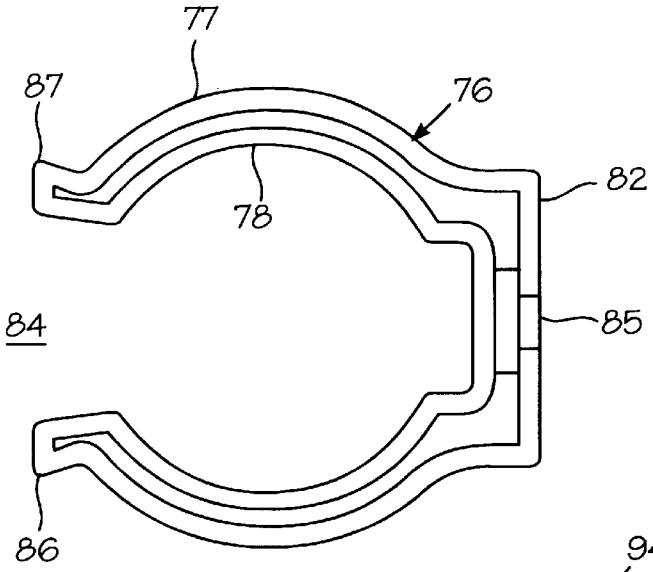
FIG. 15 illustrates a top view diagram of the clamping shoe of FIG. 11.
Figure 16:
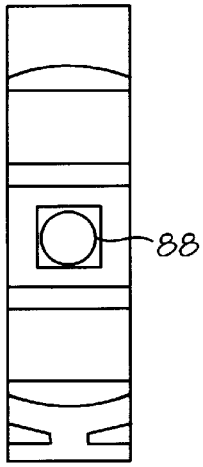
FIG. 16 illustrates a sectional end view diagram of FIG. 15.

The clamping shoe 76 is spaced between the top wall 72 and the bottom wall 73. The clamping shoe 76 has a top and bottom surface that enables it to slide along the interior surfaces of the top and bottom walls 72 and 73, respectively. The length of travel of the clamping shoe 76 may, if desired, extend from the front wall 74 to the swivel wall 75. The clamping shoe 76, FIG. 15 is substantially Ω (omega) shaped with an interior wall 78 and an exterior wall 77. The walls of the Ω-shaped clamping shoe 76 form an end portion or end wall 82 oppositely spaced from an opening 84. The end wall 82 has an aperture or hole 86 disposed therein. The aperture is sized to receive the adjusting shaft 41, FIG. 4. Adjusting shaft 41 has a head portion 88, FIG. 16 that is connected to the end wall 82. The interior wall 78 contiguous with the end wall 82 forms an interior cavity with one end open at 84. The interior wall 78 is adjacently spaced from the surface of the ball 70. The interior wall 78 has two oppositely spaced apart end portions 86 and 87 extending outward from the opening 84 towards the exterior wall 77. When the clamping shoe 76 is positioned in the housing 71, the end portions 86 and 87 extend beyond the opening in the front wall 74. The end portions 86 and 87 in a first position abut the opening of the front wall 74 in such a way that no pressure or tension is applied to the clamping shoe 76. When adjusting knob 39 is rotated in one selected direction the end wall 82 moves toward the swivel end wall 76. This movement causes a retraction of the end portions 86 and 87 towards the opening 84 accordingly applying pressure or tension on the clamping shoe 76. The interior wall 78 engages the outer surface of the ball 70 in a second position clamping the ball 70 in-place.

Figure 17:
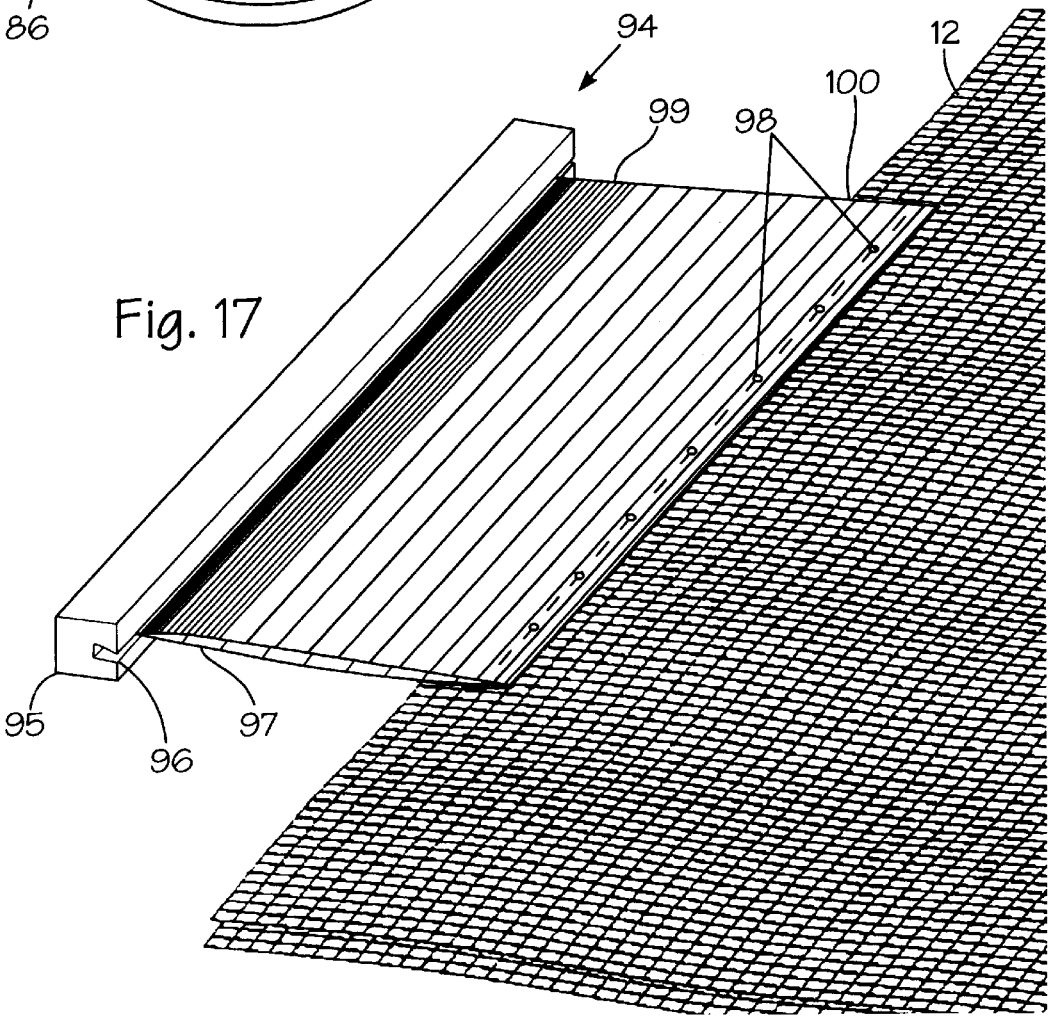
FIG. 17 illustrates a perspective view diagram of an edge tool.

An edge tool 94, FIG. 17 once properly affixed to the flexible material 12 enables it to be stretched over the inner hoop 28. The edge tool 94 may, if desired, be fabricated from the same or different material as the retaining member 14. The edge tool 94 has a substantially rectangular shape with a channel or groove 96 disposed along one edge of the tool 94. A substantially rectangular cloth sleeve 99 has one edge 97 connected to groove 96. The other edge 100 oppositely spaced from edge 97 may, if desired, be connected to the material 12 by a plurality of pins 98. The edge tool 94 drapes over the edge of the inner hoop 28 and stretches the material 12. The outer hoop 35 is then properly positioned and retained about the inner hoop (as discussed above). If desired a plurality of edge tools 94 may be used to stretch the material 12 over the inner hoop 28.

The best mode of operation of the present invention 10 is to unfold it from the folded position discussed herein. The present invention 10, in the unfolded position has the substantially T-shaped footed portion 49 disposed in the horizontal plane with the substantially rectangular portion 47 connected thereto in the vertical plane. The substantially rectangular portion 47 has disposed at one end the cantilever member 18. The cantilever member 18 has the flexible material retaining mechanism 14 connected at one end via the clamping mechanism 17.

The flexible material 12 is placed over the inner hoop 28 with the desired number of edge tools 94 connected about its perimeter. The outer hoop 35 is positioned over the inner hoop 28, resting on edge 34. The outer hoop 35 is then adjustably secured about the inner hoop 28 by adjusting knob 143.

The user may, if desired, position the retaining mechanism 14 to any convenient position in the vertical or horizontal plane. One means of positioning the retaining mechanism 14 is by loosening adjusting knob 39 of the clamping mechanism 17 thereby disengaging the clamping shoe 76 from the surface of the ball 70. Once the clamping shoe 76 is disengaged the swivel shaft 33 may be conveniently positioned. Another means of positioning the retaining mechanism relative to the user is by loosening the adjusting knob 46 and ratcheting the cantilever member 18 up or down to a convenient position. The adjusting knob 26 is tightened and the present invention 10 is now ready for use.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims, means-plus-function clause is intended to cover the structures described herein as performing the recited function and not only structural equivalents but also equivalent structures. Thus, although a nail and a screw may not be structural equivalents in that a nail employs a cylindrical surface to secure wooden parts together whereas a screw employs a helical surface, in the environment of fastening wooden parts, a nail and a screw may be equivalent structures.

I claim:

1. An apparatus for positionally retaining flexible material, comprising:

a) a substantially rectangular footed stand member;

b) an elongated cantilever member having one end adjustably disposed along said footed stand member's rectangular portion;

c) a clamping mechanism having an outwardly extending swivelably mounted first shaft, said clamping mechanism having disposed therein an adjustable clamping shoe engaging said first shaft's swivel portion;

d) said adjustable clamping shoe having a second shaft extending outwardly from said clamping mechanism, said second shaft connectively disposed along said cantilever member;

e) a retaining mechanism adjustably disposed to said clamping mechanism's first shaft, said retaining mechanism adjustably securing the flexible material;

thereby said retaining mechanism being selectively positionable about said clamping mechanism by adjusting said clamping shoe, said retaining mechanism being vertically selectively positionable by adjusting said cantilever member along said footed stand member's rectangular portion.

2. An apparatus as recited in claim 1 wherein said substantially rectangular footed stand member comprises an elongated rectangular member perpendicularly mounted to a footed stand member.

3. An apparatus as recited in claim 2 wherein said footed stand member defined as a T shaped member formed by a substantially elongated rectangularly shaped header member perpendicularly disposed to a substantially rectangular shaped base member.

4. An apparatus as recited in claim 3 wherein said header member having disposed along one edge at least one notch, said base member having disposed at one end at least one notch, said header member's notch adjoined to said base member's notch.

5. An apparatus as recited in claim 4 wherein said base member having disposed therein at least one arcuately shaped aperture, said base member further having disposed therein at least one slot, said notch and said slot each having disposed therethrough a retaining device, said notch retaining device in concert with said slot retaining device arcuately positioning said rectangular member relative to footed stand member.

6. An apparatus as recited in claim 5 wherein said cantilever member's adjustable end is an arcuately shaped ratchet working in concert with at least one securing mechanism providing adjustable positioning of said cantilever member.

7. An apparatus as recited in claim 6 wherein said clamping mechanism, comprises:

a) a substantially rectangular housing having a top wall, a bottom wall, a first end wall, and a second end wall, said walls mounted in such a way as to form an interior cavity;

b) said clamping shoe being slidably disposed between said top and said bottom walls;

c) said clamping shoe's second shaft slidably extending through said first wall, said first wall being swivelably disposed to said cantilever member; and d) said swivelably mounted first shaft having a first position extending through a first aperture of said top wall, said swivelably mounted first shaft having a second position rotated perpendicular to said top wall and extending through a channel connecting said first aperture to a second aperture in said second wall.

8. An apparatus as recited in claim 7 wherein said retaining mechanism, comprises:

a) an arcuately shaped outer bracket;

b) an arcuately shaped lower bracket;

c) an upper bracket plate and a lower bracket plate;

d) said upper and lower arcuately shaped brackets medially disposed to said upper and lower bracket plates;

e) said upper and lower arcuately shaped brackets and said upper and lower bracket plates having an aligned aperture extending therethrough, said swivelably mounted first shaft traversing said aperture;

f) said upper and lower bracket plates and said upper and lower arcuately shape brackets being adjustably secured to said swivelably mounted first shaft;

g) an inner hoop member securely mounted to said upper and lower arcuately shaped brackets; and h) an outer hoop member adjustably disposed about said inner hoop member.

9. An apparatus as recited in claim 8 wherein said inner hoop member being formed by four spaced apart sidewalls in a substantially rectangular shape, each said sidewall being connected to subsequent sidewalls via rounded corner walls, said sidewalls having outer surfaces selectively extending outwardly.

10. An apparatus as recited in claim 8 wherein said outer hoop member being formed by four spaced apart sidewalls in a substantially rectangular shape, each said sidewall being connected to subsequent sidewalls via rounded corner walls, said sidewalls having outer surfaces selectively extending outwardly.

11. An apparatus as recited in claim 10 wherein said outer hoop member's rounded corner walls in concert with said inner hoop member's rounded corner walls form a cavity therebetween.

12. An apparatus as recited in claim 11 said inner hoop member having an outwardly extending ledge engaging said outer hoop member.

13. An apparatus as recited in claim 8 further comprising:

a) an edge tool having at least one elongated shaft having a slot longitudinally disposed along one side;

b) a substantially rectangular flexible sleeve having a first edge connectively disposed to said slot;

c) said sleeve having a second edge oppositely spaced from said first edge; and d) said second edge connectively disposed to the flexible material; thereby said shaft providing tension to the flexible material and stretching the material about said inner hoop.

* * * * *